US011217910B2

(12) United States Patent
Baumeister et al.

(10) Patent No.: US 11,217,910 B2
(45) Date of Patent: Jan. 4, 2022

(54) TERMINAL CLAMP WITH INSERTION FUNNEL

(71) Applicant: BJB GmbH & Co. KG, Arnsberg (DE)

(72) Inventors: Olaf Baumeister, Sundern (DE); Philipp Henrici, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 16/945,889

(22) Filed: Aug. 2, 2020

(65) Prior Publication Data

US 2021/0098901 A1 Apr. 1, 2021

(30) Foreign Application Priority Data

Sep. 26, 2019 (DE) ..... 102019125895.2

(51) Int. Cl.
*H01R 13/187* (2006.01)
*H01R 4/48* (2006.01)

(52) U.S. Cl.
CPC ..... *H01R 4/4818* (2013.01)

(58) Field of Classification Search
CPC ... H01R 4/4818; H01R 12/515; H01R 4/4827
USPC ..... 439/852
See application file for complete search history.

(56) References Cited

U.S. PATENT DOCUMENTS 5,702,272 A * 12/1997 Machida ..... H01R 13/113 439/843
6,050,862 A * 4/2000 Ishii ..... H01R 13/187 439/843
6,171,155 B1 * 1/2001 Miwa ..... H01R 13/187 439/845
10,153,575 B2 * 12/2018 Stolze ..... H01R 4/4809
2003/0220015 A1 * 11/2003 Ishiyama ..... H01R 13/187 439/595
2015/0047183 A1 2/2015 Boyd, Jr. et al.
2017/0005421 A1 1/2017 Urano
2018/0212342 A1 * 7/2018 Koellmann ..... H01R 13/115
2018/0254567 A1 * 9/2018 Stolze ..... H01R 13/187
(Continued)

FOREIGN PATENT DOCUMENTS

DE 102006010622 B3 8/2007
DE 102015115791 A1 3/2017
(Continued)

*Primary Examiner* — Abdullah A Riyami
*Assistant Examiner* — Nelson R. Burgos-Guntin
(74) *Attorney, Agent, or Firm* — Von Rohrscheidt Patents

(57) ABSTRACT

A terminal clamp including a contact cage including a cage floor, a cage ceiling and two cage side walls that are arranged opposite to each other and respectively connect the cage floor with the cage ceiling, wherein the cage floor, the cage ceiling and the two cage side walls form an inner enveloping surface in combination and envelop a conductor receiving cavity; a clamping device formed by at least one spring element and a reaction bearing, the clamping device configured to support and electrically contact an electrical conductor in the conductor receiving cavity; a frontal conductor insertion opening that is enveloped by the two cage side walls, the cage ceiling and the cage floor, wherein the electrical conductor is insertable through the conductor insertion opening into the conductor receiving cavity and feedable to the clamping device; a contact cage longitudinal axis oriented in the conductor insertion direction.

10 Claims, 4 Drawing Sheets

(56) References Cited

U.S. PATENT DOCUMENTS

| | | | | |
|---|---|---|---|---|
| 2021/0098901 | A1* | 4/2021 | Baumeister ..... | H01R 4/4818 |
| 2021/0098902 | A1* | 4/2021 | Baumeister ..... | H01R 4/4827 |

FOREIGN PATENT DOCUMENTS

| | | | |
|---|---|---|---|
| DE | 202015103005 | U1 | 6/2017 |
| DE | 102015122400 | A1 | 8/2017 |
| DE | 202017101148 | U1 | 6/2018 |
| EP | 2122764 | B1 | 6/2018 |
| JP | 2015015112 | A | 1/2015 |
| KR | 20190046639 | | 5/2019 |

* cited by examiner

TERMINAL CLAMP WITH INSERTION FUNNEL

RELATED APPLICATIONS

This application claims priority from German patent application DE10 2019 125 895.2, filed on Sep. 26, 2019, which is incorporated in its entirety by this reference.

FIELD OF THE INVENTION

The invention relates to a terminal clamp with a contact cage including a cage floor, a cage ceiling and two cage side walls that are arranged opposite to each other and respectively connect the cage floor with the cage ceiling wherein the cage floor, the cage sealing and the two opposite side walls form an enveloping surface in combination and envelop a conductor receiving space; a clamping device formed by at least one spring element and a reaction bearing configured to support and electrically contact an electrical conductor; a front side conductor insertion opening that tis enveloped by the cage side walls, the cage ceiling and the cage floor wherein the electrical conductor is insertable through the conductor insertion opening into the conductor receiving cavity and feedable to the clamping device; a contact cage longitudinal axis oriented in the conductor insertion direction, wherein the contact cage includes a cylindrical cross sectional contour that extends from the face of the contact cage to an end of the contact cage that is arranged opposite to the face.

BACKGROUND OF THE INVENTION

Terminal clamps of this type are placed in particular directly on circuit boards as so called surface mount devices (SMD) in order to establish a connection with conductors, in particular cables which are used for supplying power or feeding control signals. Terminal clamps of this type are typically configured without a housing and arranged in series adjacent to each other on circuit boards. Thus, distances between two contact plates are reduced to a minimum which typically only corresponds to the required insulation distance.

A generic terminal clamp is known e.g. from DE 10 2015 115 791 A1. This clamp facilitates opening the clamping device that is formed by the reaction bearing and the spring element. Thus, the spring element can be moved away from the reaction bearing using an actuation handle that laterally protrudes from a cage side wall.

DE 10 2015 122 400 A1 discloses a manually usable actuation tool for opening the clamping device. This actuation tool envelops the contact cage and cooperates with the actuation handle of the prior art terminal clamp recited supra in order to open the clamping device.

Furthermore DE 10 2015 122 400 A1 discloses a variant of the actuation tool that includes a terminal clamp that is arranged in front of a conductor insertion opening of the terminal clamp that is spread relative to a remaining outer contour and that forms an insertion funnel that is arranged in front of the conductor insertion opening. When this embodiment of the actuation tool contacts the prior art terminal clamp the insertion funnel improves the insertion of connection cables, in particular insertion cable where the conductor has several wires.

The essential disadvantage of the prior art is that a space is required between the two opposite connection clamps wherein the space is larger than the required insulation distance in order to apply the actuation tool with its insertion funnel. Another decisive advantage is that no insertion funnel is provided when the terminal clamps are automatically outfitted with connection conductors.

BRIEF SUMMARY OF THE INVENTION

Thus, it is an object of the invention to provide a terminal clamp in particular without housing wherein the terminal clamp is usable for manual insertion and automated insertion in particular of multi-wire connection conductors while providing minimum arrangement distances.

The object is achieved by a terminal clamp including a contact cage including a cage floor, a cage ceiling and two cage side walls that are arranged opposite to each other and respectively connect the cage floor with the cage ceiling, wherein the cage floor, the cage ceiling and the two cage side walls form an inner enveloping surface in combination and envelop a conductor receiving cavity; a clamping device formed by at least one spring element and a reaction bearing, the damping device configured to support and electrically contact an electrical conductor in the conductor receiving cavity; a frontal conductor insertion opening that is enveloped by the two cage side walls, the cage ceiling and the cage floor, wherein the electrical conductor is insertable through the conductor insertion opening into the conductor receiving cavity and feedable to the clamping device; a contact cage longitudinal axis oriented in the conductor insertion direction; and a cuboid outer contour that extends from a front face of the contact cage at the frontal conductor insertion opening to an end of the contact cage that is arranged opposite to the front face, wherein the inner enveloping surface of the contact cage includes a constricted portion downstream of the conductor insertion opening in the conductor insertion direction so that the conductor receiving cavity is constricted, wherein the constricted enveloping surface forms at least one slanted support surface within a perpendicular cross section contour in a portion of the conductor insertion opening, and wherein the at least one slanted support surface is configured to displace the electrical conductor towards the contact cage longitudinal axis when the electrical conductor is inserted into the terminal clamp.

According to the invention the conductor insertion opening is provided with at least one slanted support surface in that the enveloping surface of the contact cage of the terminal clamp is contracted in portions. The contracted portion is arranged in particular between the conductor insertion opening and the clamping device.

Through the configuration of the terminal clamp according to the invention a slanted support surface can be arranged that is configured to support a multi-wire conductor without increasing a housing size of the terminal clamp. Thus, the contracted portion of the enveloping surfaces displaces the conductor in a direction towards a contact cage longitudinal axis and thus in a direction towards a center of the contact cage. This way a position of the conductor in the inserted condition is optimized.

In an advantageous embodiment it is provided that the at least one slanted support surface is formed by a cage side wall wherein both cage side walls advantageously form a respective slanted support surface.

Thus, the centering of the conductor that is inserted into the terminal clamp is significantly improved.

It is furthermore provided that the cage floor forms a tongue that extends from the conductor insertion opening in a direction towards an end of the contact cage and that forms an additional slanted support surface, in particular when the slanted support surfaces form an insertion funnel together with the cage floor wherein the insertion funnel is downstream of the insertion opening in a plug in direction.

This way it is assured that slanted surfaces that taper towards each other in a funnel shape facilitate a centering of the conductor along a direction of the contact longitudinal axis or longitudinal axis of the terminal clamp or longitudinal axis of the contact cage when the conductor is inserted into the terminal clamp.

It is furthermore provided that the cage ceiling includes an engagement opening for an opening tool in a transition portion to a respective side wall wherein the engagement opening facilitates access to the spring element.

It is furthermore provided that the cage ceiling includes a respectively engagement opening for an opening tool in a transition portion to the respective side wall wherein the engagement opening facilitates access to the spring element.

Last not least an opening tool is provided wherein operating elements that are arranged in the engagement openings are arranged upstream of the clamping device in the conductor insertion direction and further restrict the conductor receiving cavity relative to the constricted enveloping surface and provide additional support for the conductor to be inserted in the direction of the contact cage longitudinal axis.

In an advantageous embodiment it is provided that the engagement openings extend partially into the respective side wall.

It is furthermore provided that an approximately roof shaped inclined intermediary wall is provided in the constricted enveloping surface portion between the cage ceiling and at least one side wall wherein the intermediary wall connects the cage ceiling and the side wall wherein a roof shaped inclined respective intermediary wall is advantageously arranged between the cage ceiling and each side wall.

It is furthermore provided that the inner surface of the cage ceiling is provided with a profile, in particular with grooves in the portion of the clamping device wherein the grooves provide improved support of the conductor in the clamping device.

BRIEF DESCRIPTION OF THE DRAWINGS

An improved comprehension of the invention and further advantages of the invention can be derived from the subsequent description of an embodiment, with reference to drawing figures, wherein.

DETAILED DESCRIPTION OF THE INVENTION

Figure 1:
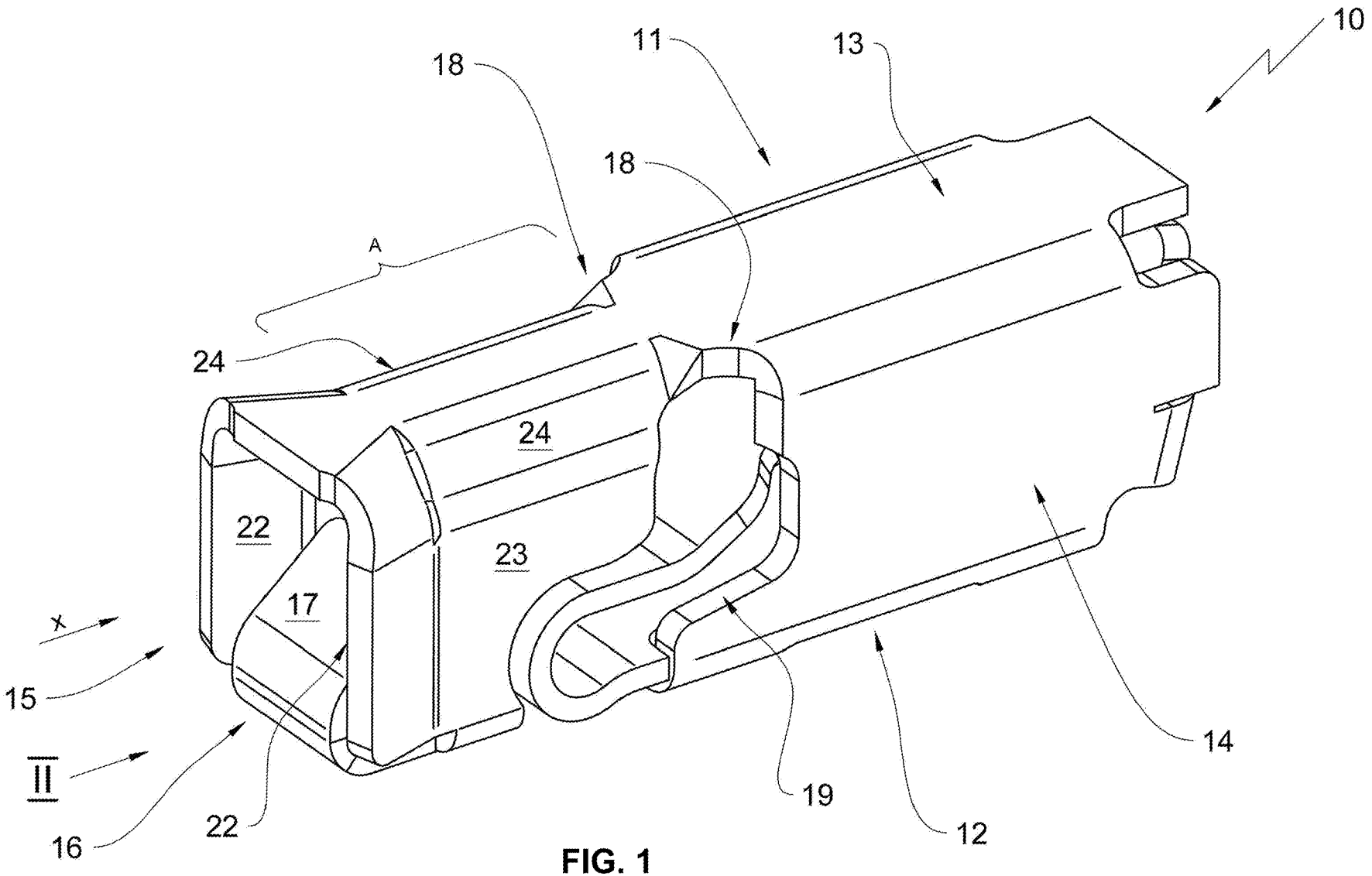
FIG. 1 illustrates a perspective view of a terminal clamp according to the invention.

A terminal clamp according to the invention is provided with reference numeral 10 in the drawing figures.

The terminal clamp 10 is illustrated in FIG. 1 in a perspective view. The terminal clamp 10 according to the invention is e.g. a surface mounted device (SMD) which is applied to circuit boards not illustrated herein in order to provide a power supply and control signal supply for electrical and electronic components arranged on the circuit board.

The terminal clamp 10 according to the invention is a terminal clamp 10 without housing, thus a terminal clamp 10 that is not enveloped by a housing made from insulation material.

The terminal clamp 10 according to FIG. 1 includes a contact cage 11 that essentially includes an outer contour configured as a cuboid. The contact cage 11 is formed by a cage floor 12, a cage ceiling 13 and two cage side walls 14. Thus the cage side walls 14 are arranged opposite to one another and connect the cage floor 12 with the cage ceiling 13.

The cage floor 12 and the cage side walls 14 jointly form an enveloping surface of the contact cage 11 and envelop a conductor receiving cavity 15.

One of the faces of the cylindrical contact cage 11 forms a conductor insertion opening 15 and is configured without a rim in this embodiment. Alternatively the face can be partially closed by a face wall. The conductor insertion opening 15 is enveloped by the cage ceiling 13 and the cage side walls 14 and the cage floor 12 wherein the cage floor 12 forms a guide zone 16 which extends from the conductor insertion opening 15 in a direction towards an opposite end of the contact cage and that forms a slanted support surface 17.

The cage ceiling 13 is provided with two engagement openings 18 wherein an opening tool can enter the contact cage 11 through the engagement openings 18. The engagement openings 18 are arranged in a transition portion towards the respective cage side wall 14 so that a bar shaped section of the cage ceiling 13 remains between the opposite engagements openings 18.

The cage side walls include opposite cut outs 19. The cut outs 19 support a spring element 30 of the terminal clamp 10 in the contact cage 11. On the other hand side the engagement openings 18 of the cage ceiling 13 transition into the cut outs 19 of the cage side walls 14. Therefore the engagement openings 18 also extend into the respective cage side wall 14.

Starting from the conductor insertion opening 15, a contact longitudinal axis that is not illustrated in FIG. 1 extends in a direction towards an opposite end of the connection clamp. The contact cage includes a so called perpendicular cross sectional contour that extends essentially from the face that forms the conductor insertion opening 15 to an end of the contact cage that is arranged opposite to the face. In this embodiment, the perpendicular cross sectional contour is cylindrical. The perpendicular cross sectional contour defines the installation space required by the terminal clamp 10 with respect to height and width.

As illustrated in FIG. 1, the contact cage 11 includes a section Ain which the enveloping surface of the contact cage is contracted relative to the perpendicular cross sectional contour. This contracted section is arranged downstream in the conductor insertion direction x with respect to the conductor insertion opening 15 or the face of the contact cage 11 and extends in the embodiment into the portion of the engagement openings 18. A further extension, e.g. into a clamping device 21 that supports the conductor in the terminal clamp 10 and which will be described infra is also conceive able.

In the embodiment only the cage side walls 14 are offset inward relative to the perpendicular cross sectional contour of the contact cage 11. However it is also conceivable to contract the cage ceiling 13 and/or the cage floor 12 in an inward direction or in a direction towards the cage longitudinal axis.

The contracted section forms slanted support surfaces 22 for the side walls in the portion of the conductor insertion opening 15.

Figure 2:
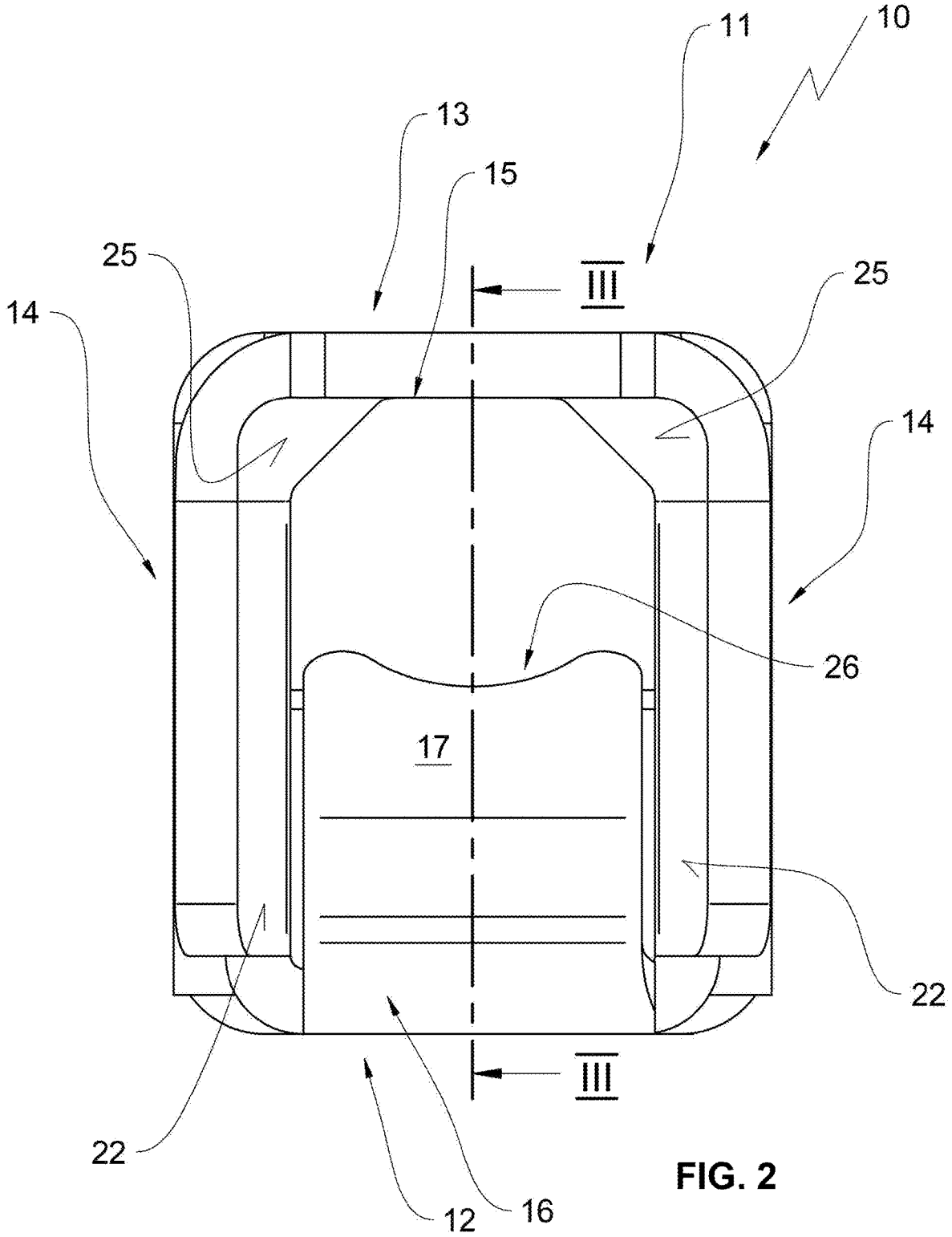
FIG. 2 illustrates a view of the conductor insertion opening of the terminal clamp according to FIG. 1.

FIG. 2 illustrates in particular in combination with FIG. 1 that an intermediary wall 24 is arranged between the cage ceiling 13 and the contracted cage side wall sections 23. The intermediary wall is slanted so that a roof shaped section is formed.

Introducing the intermediary walls 24 contracts the inner cross section of the contact cage 11 in a portion A of the contracted enveloping surface. Furthermore additional slanted support surfaces 25 are formed in a portion of the conductor insertion opening 15 wherein the slanted support surfaces transition into the respective intermediary wall 24.

FIG. 2 illustrates a view on the face of the contact cage 11 and of the conductor insertion opening 15 showing that each of the slanted support surfaces 17 (slanted support surface of the guide tongue 16), 22 (slanted support surface of the respective cage side wall 14) and 25 (slanted support surface of the respective intermediary wall 24) independently direct a conductor to be inserted towards a non-marked center of the conductor receiving cavity. The slanted surfaces 17, 22, and 25 jointly form a funnel shaped insertion aide that essentially centers the conductor.

This is particularly advantageous for multi-wire cables which otherwise form a mushroom head when they impact surfaces that are arranged essentially transversal to the conductor insertion direction. Furthermore centering is advantageous with respect to supporting the cable to be connected in the clamping device to be described infra.

Advantageously the circular arc shape cut out 26 is arranged at a free end of the guide tongue 16 and an apex point of the arc is arranged approximately in the longitudinal center plane of the contact cage 11.

Figure 3A:
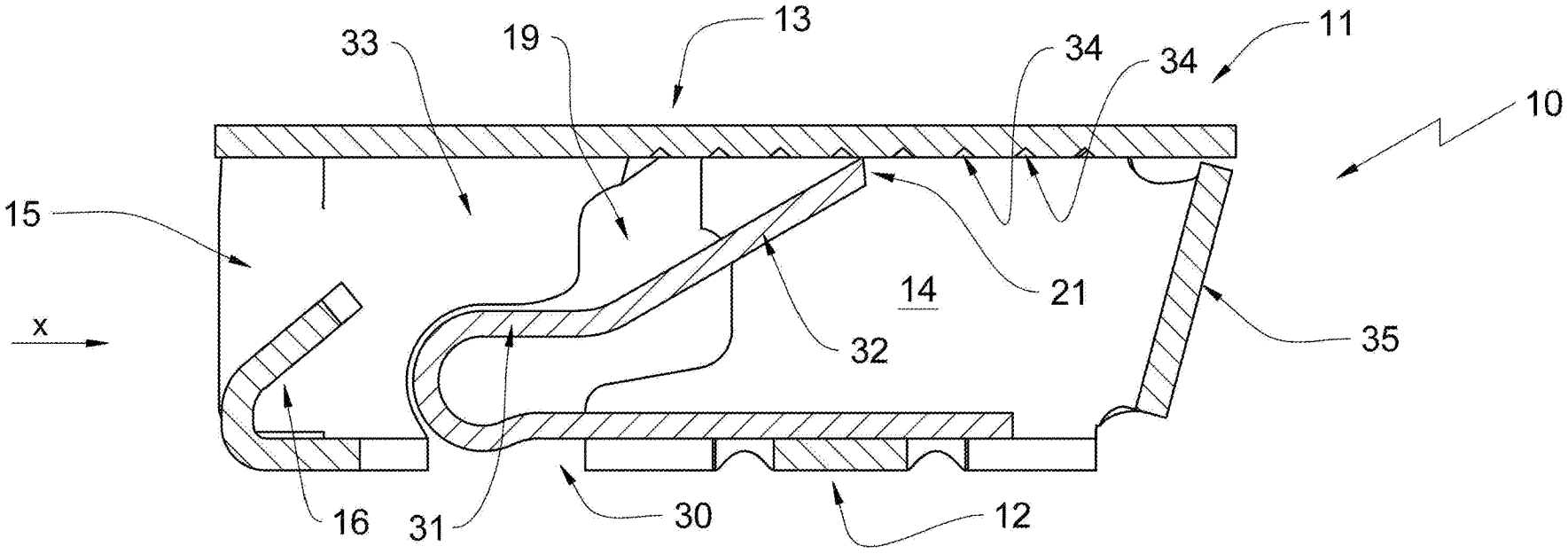
FIG. 3A illustrates a vertical longitudinal sectional view of the terminal clamp according to sectional line III-III in FIG. 2 with the spring element configured to form the clamping device.
Figure 3B:
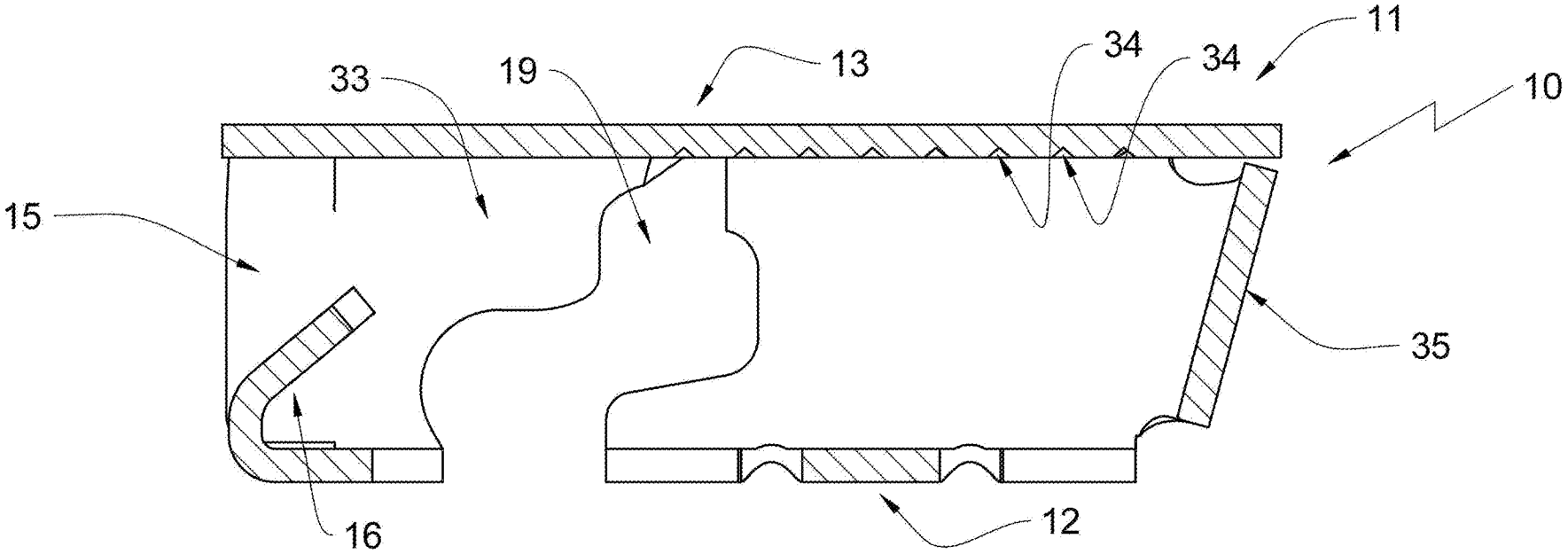
FIG. 3B illustrates a view according to FIG. 3A, however without a representation of the spring element.

FIGS. 3A and 3B show a vertical longitudinal sectional view through the contact cage 11 along the sectional plane III-III in FIG. 2. FIG. 3A illustrates the contact cage 11 including the spring element 30. FIG. 3B illustrates the contact cage 11 without the spring element. FIGS. 3A and 3B illustrate the cage ceiling, a cage side wall with cut out 19 and a cage base 12 which forms the guide tongue 16 in the portion of the conductor insertion opening 15.

The spring element 30 has a cross section that is bent approximately U-shaped, wherein the arm oriented towards the cage ceiling 13 initially forms a support section 31 that is approximately parallel to the cage floor and an adjoining clamping section 32. The clamping section 32 is preloaded against an inside of the cage ceiling. Thus, the cage ceiling 13 forms a reaction bearing for the clamping section 32 or the spring element 30. The reaction bearing and the clamping section 32 form the clamping device.

When a conductor, in particular a connection cable is inserted in the conductor insertion direction x through the conductor insertion opening 15 into the conductor receiving cavity 33 the conductor displaces the clamping section 32 from the start position illustrated in FIG. 3A in a direction towards the cage floor 12. The spring tension thus created moves the conductor end towards the cage ceiling 13. An inner surface of the cage ceiling is provided with a profile, in the instant embodiment the profile is formed by a series of notches 34. This profile increases friction between the conductor and the cage ceiling 13 which is supported by the clamping section 32 and thus improves support of the conductor in the terminal clamp.

The conductor receiving cavity 33 is a portion that extends between the plane of the support section 31 and the cage ceiling. Thus, the portion is in the illustrated embodiment above a horizontal longitudinal plane of the cage that is defined approximately by the surface of the contact section 31. The contact cage 11 includes a rear wall 35 at an end that is opposite to the conductor insertion opening 15. The rear wall stabilizes the cage against deformation. On the other hand side the rear wall prevents a penetration of larger contaminant particles that get lodged between the clamping section 32 and the cage floor 12 so that a displacement of the clamping section would be impeded.

The invention provides a connection clamp 10 with slanted surfaces 17, 22, 25 which facilitates an insertion of conductors into the terminal clamp 10 and a centering of the conductors in the terminal clamp 10 without increasing an installation space that is required for the terminal clamp 10. This is facilitated in that a portion of the contact cage 11 that is downstream of the conductor insertion opening 15 in the conductor insertion direction is contracted relative to the perpendicular cross sectional contour. This improves centering of the conductor in the clamping device in particular when the wire insertion is fully automated wherein a conductor that is inserted into the terminal clamp 10 by a robot is displaced in a direction towards a center of the clamping device in spite of the insertion tool being off center.

REFERENCE NUMERALS AND DESIGNATIONS

10 terminal clamp
11 contact cage
12 cage floor
13 cage ceiling
14 cage side wall
15 conductor insertion opening
16 guide tongue
17 slanted support surface
18 engagement opening
19 cut out
21 clamping device
22 slanted support surface
23 constricted cage side wall section
24 intermediary wall
25 slanted support surface
26 spherical section
30 spring element
31 support section
32 clamping section
33 conductor receiving cavity
34 notch
35 rear wall
A constricted section
x conductor insertion direction

What is claimed is:

1. A terminal clamp, comprising:

a contact cage including a cage floor, a cage ceiling and two cage side walls that are arranged opposite to each other and respectively connect the cage floor with the cage ceiling, wherein the cage floor, the cage ceiling and the two cage side walls form an inner enveloping surface in combination and envelop a conductor receiving cavity;

a clamping device formed by at least one spring element and a reaction bearing, the clamping device configured to support and electrically contact an electrical conductor in the conductor receiving cavity;

a frontal conductor insertion opening that is enveloped by the two cage side walls, the cage ceiling and the cage floor, wherein the electrical conductor is insertable through the conductor insertion opening into the conductor receiving cavity and feedable to the clamping device;

a contact cage longitudinal axis oriented in the conductor insertion direction; and a cuboid outer contour that extends from a front face of the contact cage at the frontal conductor insertion opening to an end of the contact cage that is arranged opposite to the front face, wherein the inner enveloping surface of the contact cage includes a constricted portion downstream of the conductor insertion opening in the conductor insertion direction so that the conductor receiving cavity is constricted, wherein the constricted portion forms at least one slanted support surface downstream of the conductor insertion opening in the conductor insertion direction, wherein the at least one slanted support surface is configured to displace the electrical conductor towards the contact cage longitudinal axis when the electrical conductor is inserted into the terminal clamp, wherein the inner enveloping surface of the contact cage includes an expanded portion arranged downstream of the constricted portion in the conductor insertion direction so that the conductor receiving cavity is expanded relative to the constricted portion and an inner width of the conductor receiving cavity between the cage side walls is increased relative to the constricted portion.

2. The terminal clamp according to claim 1, wherein the at least one slanted support surface is formed by one of the two cage side walls, or wherein the at least one slanted support surface includes two slanted support surfaces that are each formed by one of the two cage side walls respectively.

3. The terminal clamp according to claim 2, wherein the cage floor forms a tongue that extends from the frontal conductor insertion opening in a direction towards the end of the contact cage and forms another of the at least one slanted support surface.

4. The terminal clamp according to claim 3, wherein the at least one slanted support surface forms an insertion funnel together with the cage ceiling, and wherein the insertion funnel is arranged downstream of the insertion opening in the conductor insertion direction.

5. The terminal clamp according to claim 1, wherein the clamping device is arranged downstream of the constricted portion in the conductor insertion direction.

6. The terminal clamp according to claim 1, wherein the cage ceiling includes a respective engagement opening for an opening tool in a respective transition portion to a respective cage side wall of the two cage side walls, and wherein the respective engagement opening facilitates an access to the at least one spring element.

7. The terminal clamp according to claim 6, further comprising:

an opening tool, wherein operating elements of the opening tool that are insertible into the respective engagement openings are arranged upstream of the clamping device in the conductor insertion direction and further constrict the conductor receiving cavity in the constricted portion and guide the electrical conductor towards the longitudinal axis of the contact cage during insertion of the electrical conductor.

8. The terminal clamp according to claim 6, wherein the respective engagement opening extends partially into the respective cage side wall.

9. A terminal clamp, comprising:

a contact cage including a cage floor, a cage ceiling and two cage side walls that are arranged opposite to each other and respectively connect the cage floor with the cage ceiling, wherein the cage floor, the cage ceiling and the two cage side walls form an inner enveloping surface in combination and envelop a conductor receiving cavity;

a clamping device formed by at least one spring element and a reaction bearing, the clamping device configured to support and electrically contact an electrical conductor in the conductor receiving cavity;

a frontal conductor insertion opening that is enveloped by the two cage side walls, the cage ceiling and the cage floor, wherein the electrical conductor is insertable through the conductor insertion opening into the conductor receiving cavity and feedable to the clamping device;

a contact cage longitudinal axis oriented in the conductor insertion direction; and a cuboid outer contour that extends from a front face of the contact cage at the frontal conductor insertion opening to an end of the contact cage that is arranged opposite to the front face, wherein the inner enveloping surface of the contact cage includes a constricted portion downstream of the conductor insertion opening in the conductor insertion direction so that the conductor receiving cavity is constricted, wherein the constricted portion forms at least one slanted support surface downstream of the conductor insertion opening in the conductor insertion direction, wherein the at least one slanted support surface is configured to displace the electrical conductor towards the contact cage longitudinal axis when the electrical conductor is inserted into the terminal clamp, wherein a slanted intermediary wall is arranged in the constricted portion between the cage ceiling and at least one side wall of the two side cage walls side wall, wherein the slanted intermediary wall connects the cage ceiling and the side at least one cage side wall, and wherein a respective slanted intermediary wall is arranged between the cage ceiling and each of the two cage side walls.

10. The terminal clamp according to claim 1, wherein an inner surface of the cage ceiling is provided with a profile or grooves in a portion of the clamping device, and wherein the profile or the grooves improve a support of the electrical conductor in the clamping device.

* * * * *